US010818455B2

(12) United States Patent
Djogo

(10) Patent No.: US 10,818,455 B2
(45) Date of Patent: Oct. 27, 2020

(54) SERIES VACUUM INTERRUPTERS WITH GRADING CAPACITORS INTEGRATED IN A MOLDED SWITCH HOUSING

(71) Applicant: S&C Electric Company, Chicago, IL (US)

(72) Inventor: Goran Djogo, Mount Prospect, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 16/667,403

(22) Filed: Oct. 29, 2019

(65) Prior Publication Data

US 2020/0161065 A1 May 21, 2020

Related U.S. Application Data

(60) Provisional application No. 62/769,198, filed on Nov. 19, 2018.

(51) Int. Cl.

| | |
|---|---|
| ***H01H 33/66*** | (2006.01) |
| ***H01H 33/59*** | (2006.01) |
| ***H01H 33/666*** | (2006.01) |
| ***H01H 33/14*** | (2006.01) |

(52) U.S. Cl.

CPC ..... *H01H 33/66* (2013.01); *H01H 33/59* (2013.01); *H01H 2033/146* (2013.01); *H01H 2033/6668* (2013.01)

(58) Field of Classification Search

CPC .. H01H 33/66; H01H 33/59; H01H 33/66207; H01H 33/66261; H01H 33/664; H01H 2033/6623; H01H 2033/66223; H01H 33/14; H01H 2033/146; H01B 17/28

USPC ..... 218/118, 144, 145, 147, 134, 138, 139, 218/155; 200/600

See application file for complete search history.

(56) References Cited

U.S. PATENT DOCUMENTS

| | | | | |
|---|---|---|---|---|
| 2,930,952 | A * | 3/1960 | Glauber | H01G 4/02 361/279 |
| 8,658,932 | B2 * | 2/2014 | Schellekens | H01H 9/54 218/122 |
| 9,472,347 | B2 * | 10/2016 | Abrecht | H01G 5/14 |
| 9,691,548 | B2 * | 6/2017 | Tanner | H01G 4/224 |
| 2018/0301304 | A1 * | 10/2018 | Wang | H01B 17/28 |

* cited by examiner

*Primary Examiner* — William A Bolton

(57) ABSTRACT

A switching module for use in a high voltage switch includes: a vacuum interrupter (VI), an elastomeric insulating sleeve disposed around the VI; an insulating housing molded around the VI and the sleeve; and a pair of grading capacitors. Each grading capacitor includes an inner and an outer electrode while insulation between the electrodes is solid insulation of the housing molded at the time when the housing is molded. One of the electrodes is galvanically connected to the fixed contact through a first terminal in the switching module and the other electrode is galvanically connected to the moving contact through a second terminal in the switching module. The capacitance of the first grading capacitor is substantially equal to the capacitance of the second grading capacitor.

20 Claims, 5 Drawing Sheets

SERIES VACUUM INTERRUPTERS WITH GRADING CAPACITORS INTEGRATED IN A MOLDED SWITCH HOUSING

CROSS-REFERENCE TO RELATED APPLICATION

This application claims the benefit of priority from the U.S. Provisional Application No. 62/769,198, filed on Nov. 19, 2018, the disclosure of which is hereby expressly incorporated herein by reference for all purposes.

TECHNICAL FIELD

The subject matter described herein relates generally to high voltage switching devices with series vacuum interrupters, and more particularly to vacuum interrupters with integrated grading capacitors.

BACKGROUND

Vacuum interrupters are used in utility power transmission systems and power generation units and can be a core component of medium-voltage and high-voltage (HV) circuit-breakers and switches. HV circuit-breakers/switches can use multiple vacuum interrupters cascaded in series to interrupt the flow of energy through the HV circuit-breaker/switch. Equalizing the voltage across the vacuum interrupters in a circuit breaker/switch may allow the circuit breaker/switch to be used for high voltage applications because each interrupter unit will only have to handle an equal portion of the overall voltage.

Accordingly, it is desirable to provide systems and methods for achieving uniform or near uniform voltage distribution across series-connected vacuum interrupters in a HV circuit-breaker/switch. Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

Embodiments of the subject matter will hereinafter be described in conjunction with the following drawing figures, wherein like numerals denote like elements, and wherein.

DETAILED DESCRIPTION

Figure 1A:
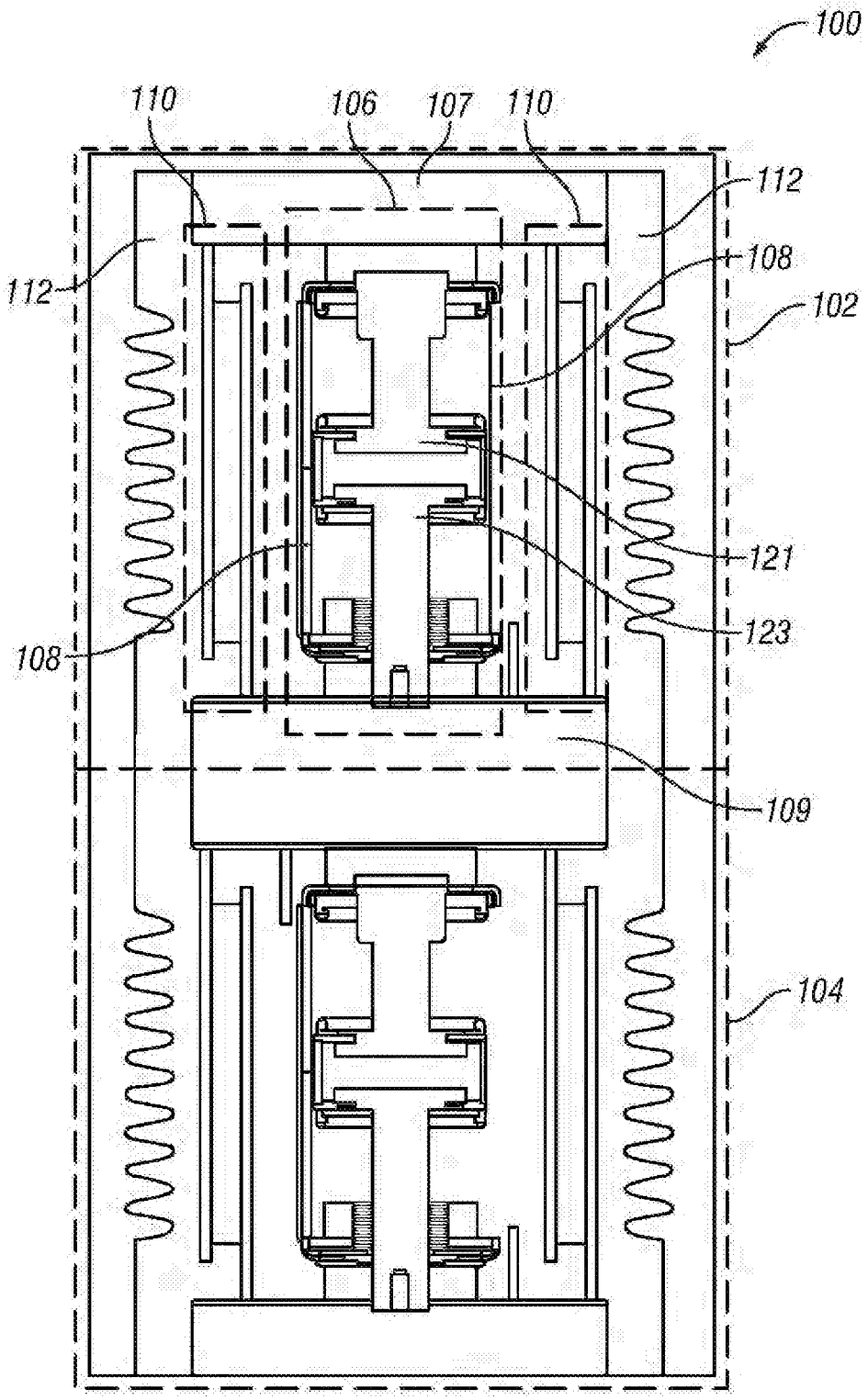
FIG. 1A is a drawing depicting a cross-sectional view of a switching section in an example high voltage (HV) switching device with series vacuum interrupters, in accordance with some embodiments.

The following detailed description is merely exemplary in nature and is not intended to limit the invention or the application and uses of the invention. Furthermore, there is no intention to be bound by any expressed or implied theory presented in the preceding technical field, background, or the following detailed description. As used herein, the words "exemplary" or "example" means "serving as an example, instance, or illustration." Thus, any embodiment described herein as "exemplary" or "example" is not necessarily to be construed as preferred or advantageous over other embodiments. All embodiments described herein are exemplary embodiments provided to enable persons skilled in the art to make or use the invention and not to limit the scope of the invention which is defined by the claims.

The subject matter described herein discloses apparatus, systems, methods, and techniques for using grading capacitors in a high voltage switching device (e.g., HV switch and/or HV circuit breaker) having series connected vacuum interrupters. In one embodiment, a switching module for use in a high voltage switching device is provided. The switching module includes: a vacuum interrupter (VI) having a fixed contact and a moving contact; an insulating sleeve disposed around the VI; an insulating housing molded around the VI and the sleeve; and a pair of grading capacitors molded in the insulating housing and including a first grading capacitor and a second grading capacitor. Each grading capacitor includes an inner and an outer electrode that are concentric and insulating material formed from the same material as the insulating material of the insulating housing disposed between the inner electrode and the outer electrode. The capacitance of the first grading capacitor is substantially equal to the capacitance of the second grading capacitor.

In another embodiment, a high voltage (HV) switching device is provided. The HV switching device includes two or more switching modules connected in series wherein each switching module includes: a vacuum interrupter (VI) having a fixed contact and a moving contact; an insulating sleeve disposed around the VI; an insulating housing molded around the VI and the sleeve; and a pair of grading capacitors molded in the insulating housing and including a first grading capacitor and a second grading capacitor. Each grading capacitor includes an inner and an outer electrode that are concentric and insulating material formed from the same material as the insulating material of the insulating housing disposed between the inner electrode and the outer electrode. The capacitance of the first grading capacitor is substantially equal to the capacitance of the second grading capacitor. Each switching module has a first and a second terminal and each pair of adjacent switching modules are connected in series with the second terminal of one of the pair of switching modules connected to the first terminal of the other of the pair of switching modules. All switching modules have the same total capacitance of the pair of grading capacitors across their VI and, when the HV switching device is in an open position and high voltage is applied across the HV switching device, substantially an equal portion of the applied high voltage exists across each of the switching modules of the HV switching device.

In another embodiment of a high voltage (HV) switching device, when, in each switching module, the VI is open and a low voltage switch coupled between the grading capacitors and the VI is closed, and high voltage is applied across the HV switching device, substantially an equal portion of the applied high voltage exists across each of the switching modules of the HV switching device.

In another embodiment of a high voltage (HV) switching device, when, in each switching module, both the VI and a low voltage switch coupled between the grading capacitors and the VI are open, capacitive current from the grading capacitors is diverted into a rectifier bridge in each switching module which charges a storage capacitor, whereby energy is harvested from a power line to which the HV switching device is connected.

FIG. 1A is a drawing depicting a cross-sectional view of a switching section in an example high voltage (HV) switching device 100 (e.g., HV switch and/or HV circuit breaker). The example switching section includes two identical switching modules 102, 104 connected in series. Although two switching modules 102, 104 connected in series are shown in this example, in other examples three or more switching modules may be connected in series. Each example switching module 102, 104 includes a vacuum interrupter (VI) 106 with an elastomeric insulating sleeve 108 disposed around the vacuum interrupter and a pair of grading capacitors 110, all of which are molded in a polymer insulating housing 112. The grading capacitors 110 use housing solid insulation for insulation between their own electrodes. The switching module 102, 104 includes a first terminal 107 that is galvanically connected to a fixed contact 121 of the VI 106 and a second terminal 109 that is galvanically connected to a moving contact 123 of the VI 106.

Figure 1B:
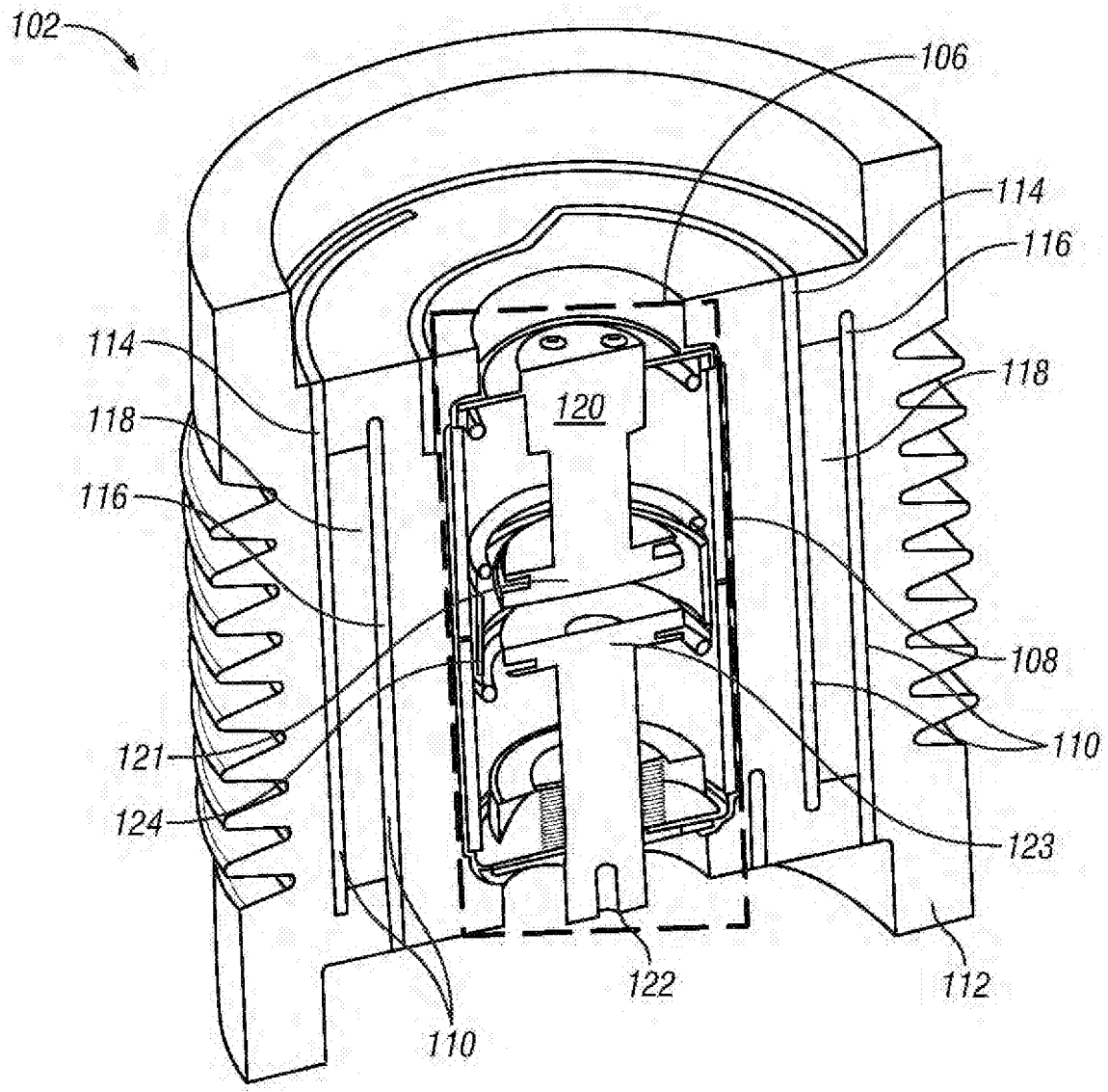
FIG. 1B is a drawing depicting a cross-sectional view of an example switching module that includes a vacuum interrupter and two pairs of conductive electrodes that are molded in a polymer housing and, thereby, form two grading capacitors in parallel with the vacuum interrupter, in accordance with some embodiments.

FIG. 1B is a drawing depicting a cross-sectional view of an example switching module 102 that includes a vacuum interrupter 106 with an elastomer sleeve 108 around the vacuum interrupter (VI) 106 and a pair of grading capacitors 110, all of which are molded in a polymer housing 112. Each grading capacitor 110 includes a pair of electrodes 114, 116 that are molded in each example switching module 102 and insulating material 118 disposed between the pair of electrodes 114, 116. Insulating material 118 is a part of the housing solid insulation and it is molded at the same time when the housing is molded. One electrode 114 is galvanically connected to a fixed contact stem 120 of the overmolded VI 106 via a terminal (not shown) and the other electrode 116 is galvanically connected to a moving VI stem 122 via a terminal (not shown). The example VI 106 includes a fixed contact 121 attached to the fixed stem 120, a moving contact 123 attached to the moving stem 122, and a vapor shield 124 surrounding the fixed contact and moving contact. The inner electrode 116 of a first grading capacitor and the outer electrode 116 of a second grading capacitor are galvanically connected to the VI moving stem 122, while the inner electrode 114 of the second grading capacitor and the outer electrode 114 of the first grading capacitor are galvanically connected to the VI fixed stem 120. As a result, both the first and second grading capacitors are connected in parallel with the VI contacts. The capacitance of the two grading capacitors 110 are substantially equal as the two grading capacitors 110 have the same geometrical dimensions.

Figure 2:
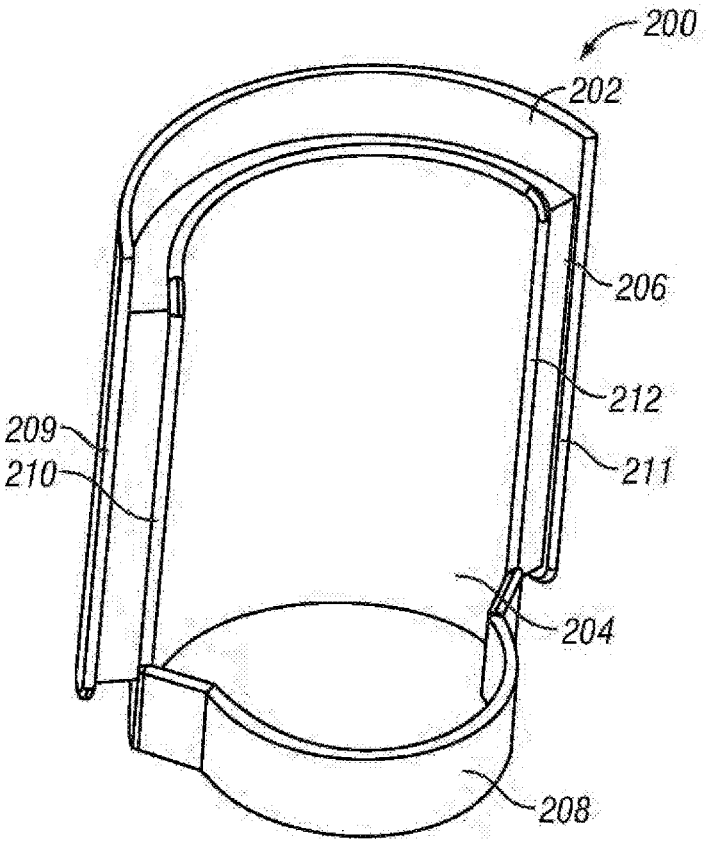
FIG. 2 is a drawing depicting an example of a pair of conductive electrodes that form a HV grading capacitor when molded in the solid insulation of a switching module, in accordance with some embodiments.

FIG. 2 is a drawing depicting an example high voltage (HV) grading capacitor 200 that can be molded in a switching module. The example grading capacitor 200 includes a pair of electrodes 202, 204 that are concentric and molded in each example switching module and insulating material 206 between the electrodes. The insulating material 206 is the solid insulation material of the switch housing and it is disposed between the set of electrodes 202, 204 at the same time when the switch housing is molded. Each example electrode 202, 204 has an arc-like shape in an x-y plane that is extruded in a z direction for a specified length. The arc angle for each example electrode 202, 204 is less than 180° and in some examples the arc angle is 150° wherein a gap exists between arc ends of the two inner electrodes in each grading capacitor and the gap is sufficiently large for reliable long-term dielectric performance. The example inner electrode 204, in its bottom portion, includes a shield section 208 that allows the bottom portion of the inner electrode 204 to extend around 360° and to completely shield the VI triple point from the outer electrode 202. The shield section of the inner electrode of the first grading capacitor (connected to the VI moving stem) is placed between the inner electrode of the second grading capacitor and the moving side of the VI and wherein the shield section of the inner electrode of the second grading capacitor (connected to the VI fixed stem) is placed between the inner electrode of the first grading capacitor and the fixed side of the VI. This allows the VI triple points to be effectively shielded from inner electrodes of the opposite potential. The two example electrodes 202, 204 in the set are offset axially (e.g., by at least 1.5 inches). The inner electrode and outer electrode of each grading capacitor have the same axis as the corresponding VI but are offset axially in order to have a sufficiently large axial distance between their ends for reliable dielectric performance. The edges 209, 210, 211, 212 of the example electrodes 202, 204 are rounded. The example electrodes 202, 204 are constructed from conductive material, for example, molded out of conductive plastics. The capacitance of the HV grading capacitor 200 can be determined by geometrical parameters (e.g., the radiuses of electrode arcs, radial gap between electrodes 202, 204, axial overlap of the electrodes 202, 204) and dielectric constant of the insulating material 206 disposed between the set of electrodes 202, 204. In some applications it can be beneficial to pre-mold high dielectric constant dielectric 206 between the electrodes 202, 204.

Figure 3A:
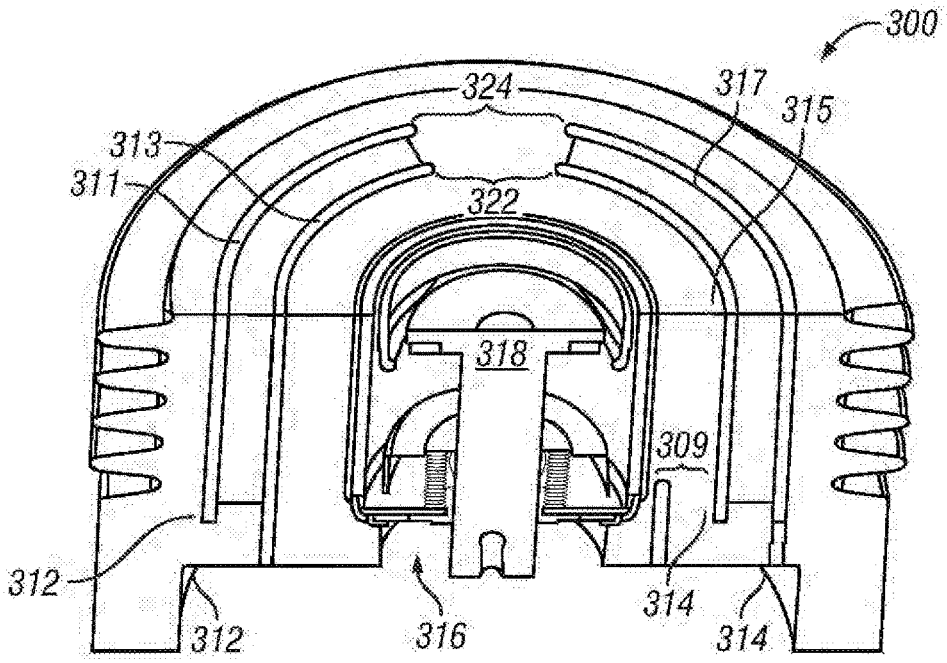
FIGS. 3A and 3B are drawings depicting horizontal cross sections of an example switching module at different vertical axial positions, in accordance with some embodiments.
Figure 3B:
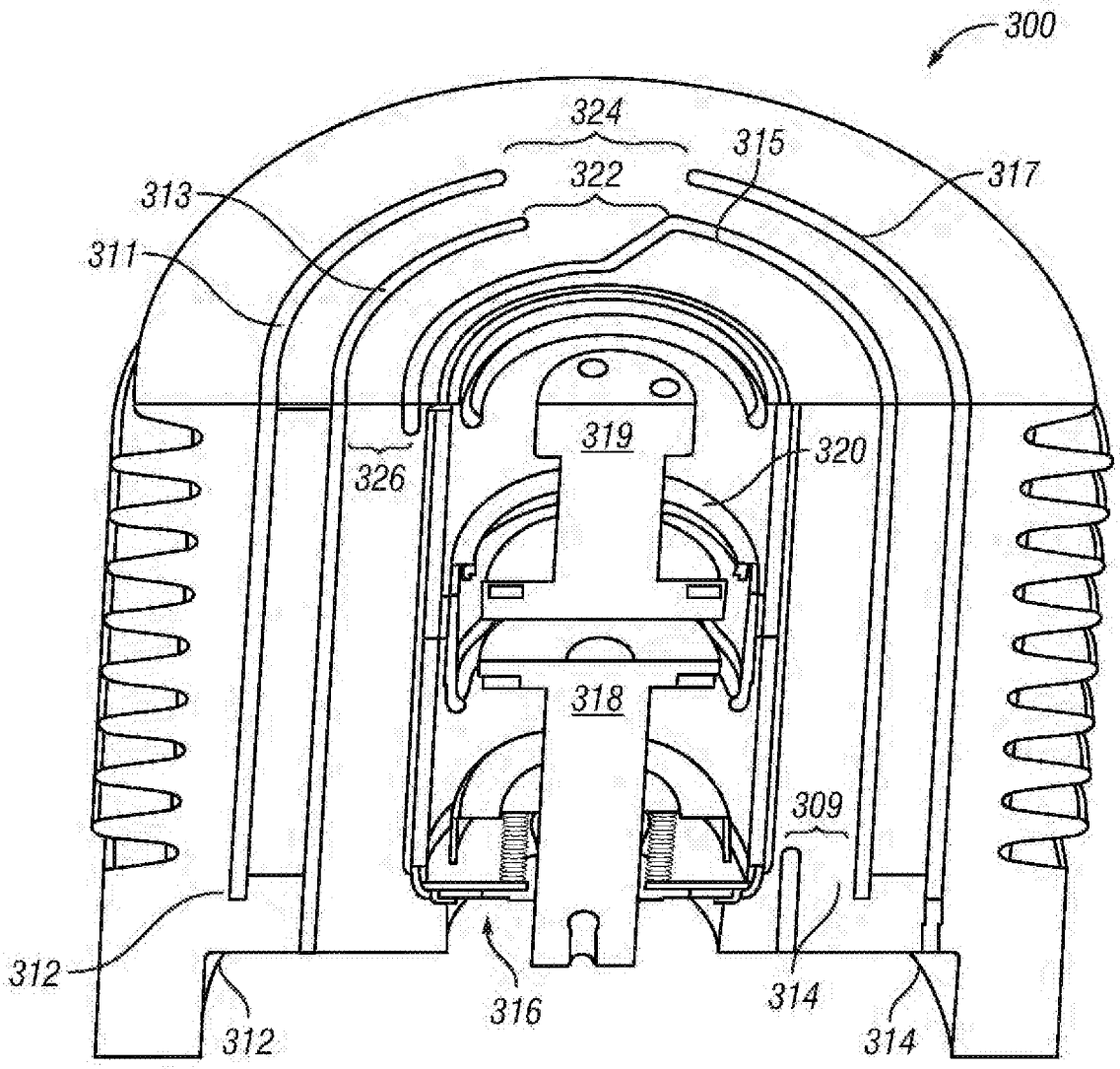

FIGS. 3A and 3B are drawings depicting horizontal cross sections of an example switching module 300 at different vertical positions. FIG. 3A illustrates an example of the mutual position of two sets of electrodes (311, 313) and (315, 317) respectively for the two grading capacitors 312, 314 at a vertical position corresponding to the top of the moving contact 318 in the VI 316. FIG. 3B also illustrates an example of the mutual position of the two sets of electrodes (311, 313) and (315, 317) respectively for the two grading capacitors 312, 314, but at a vertical position corresponding to the top of the fixed contact 319 in the VI 316. The electrodes 313 and 317 are at the same potential as they are connected to the VI terminal galvanically connected to the moving contact 318, while the electrodes 311 and 315 are at the potential of the other terminal that is galvanically connected to the stationary contact 319. The gaps 309, 322, 324, and 326, as well as the gap between electrodes 311 and 313 and the gap between electrodes 315 and 317, are sufficiently large to allow the insulation to withstand long term operation under full voltage of the switching module.

The two HV capacitors 312, 314 represented by these two sets of electrodes are connected in parallel with the VI 316 and the equivalent grading capacitance $C_{grading}$ in parallel with the VI 316 is equal to double the value of capacitance of a single electrode set 312, 314. However, there are also capacitances between the VI vapor shield 320 and the electrodes (e.g., 313, 315) and those capacitances can affect voltage distribution inside the VI 316. The use of two sets of electrodes per switching module can make voltage distribution inside a VI more uniform, whereas voltage distribution inside a VI can be highly nonuniform if only one set of electrodes is used per switching module. When two electrode sets are used, the vapor shield 320 has the same capacitance to the inner electrode 313, 315 of each of the sets. Since one inner electrode 315 is connected to the VI fixed contact 319 and the other inner electrode 313 to the VI moving contact 318, capacitances of the vapor shield 320 to the fixed contact 319 and moving contact 318 are about the same and the voltage of the vapor shield 320 with respect to the fixed contact 319 is approximately 50% of the total voltage across the VI 316.

If only one set of electrodes is used for the grading capacitance (for example, only 311 and 313), then capacitance between the vapor shield 320 and the inner electrode 313 would be significantly larger than capacitance between the vapor shield 320 and the outer electrode 311. That would lead to capacitance between the vapor shield 320 and the VI contact 318 (to which the inner electrode would be connected) to be significantly larger than the capacitance between the vapor shield 320 and the VI contact 319 (to which the outer electrode 311 would be connected). This would result in voltage between the vapor shield 320 and the VI contact 319 (to which the outer electrode would be connected) to be about 70%-80% of the total voltage across the VI, which would be quite unfavorable.

In one example, parallel grading capacitance of 200 pF per VI should be sufficient for approximately equal voltage division between the VIs that are connected in series. In an example switching device, total capacitance of 200 pF may be achieved easily for a 40 kA vacuum interrupter by using standard cycloaliphatic epoxy filled with silica as the dielectric between the electrodes and by having sufficiently large gaps between electrodes for long-term dielectric performance.

Figure 4A:
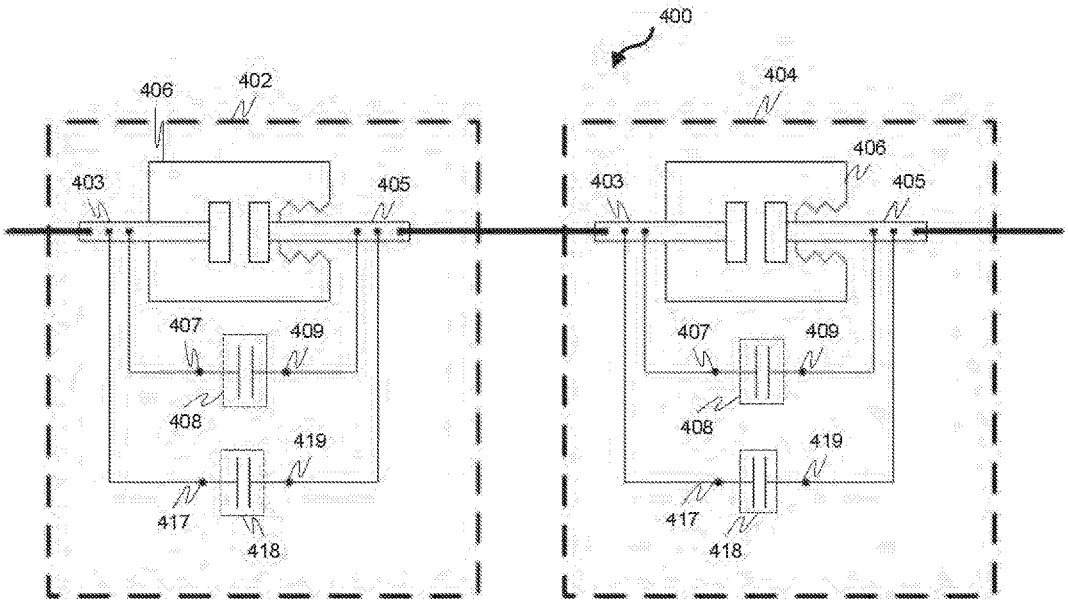
FIG. 4A is a schematic diagram illustrating an example connection of a grading capacitor in an example HV switching device, in accordance with some embodiments.

FIG. 4A is a schematic diagram illustrating an example connection of grading capacitors in an example HV switching device 400 where grading capacitors are used for equal division of total voltage among switching modules (and not for harvesting energy). The example HV switching device 400 (e.g., HV circuit breaker or HV switch) includes a first switching module 402 connected in series with a second switching module 404. Each switching module 402, 404 includes a VI 406 having a first terminal 403 and a second terminal 405 and two grading capacitors 408, 418 each with its terminals 407, 409 and 417, 419 respectively. For each module, the capacitor terminals 409 and 419 corresponding to the moving VI side are connected to the terminal 405 of the VI 406. The other capacitor terminals 407 and 417 are connected to the terminal 403 of the VI 406 for each module. The second terminal 405 of the example first switching module 402 is connected to the first terminal 403 of the example second switching module 404. In this configuration, the capacitors 408 and 418 are connected in parallel with the VI 406 in each switching module. When the VI 406 is open in each switching module, total voltage applied across the HV switching device is divided equally across the switching modules.

Figure 4B:
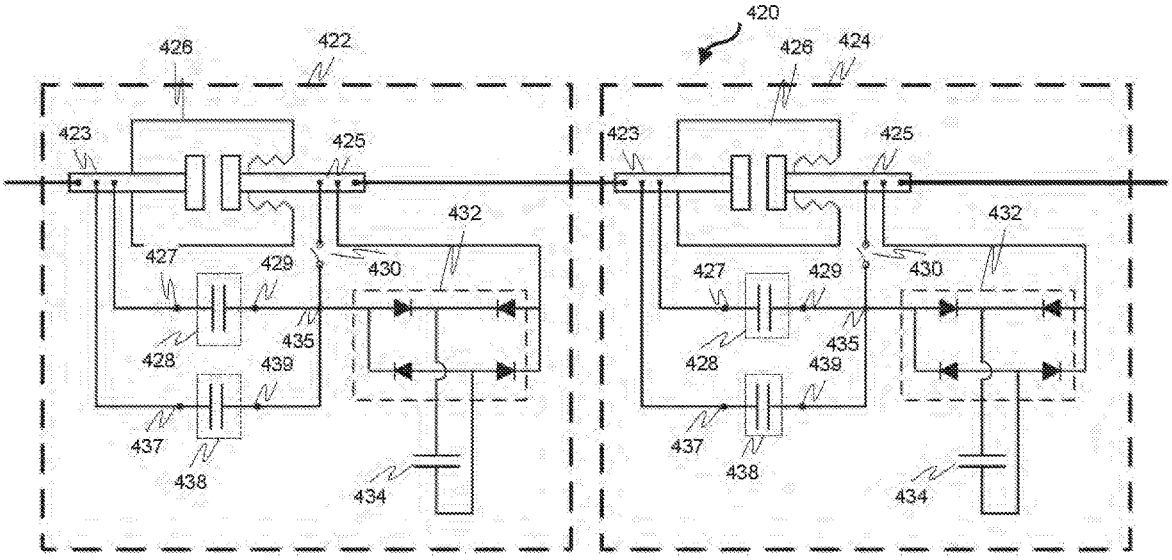
FIG. 4B is a schematic diagram illustrating an example connection of a grading capacitor in an example HV switching device wherein grading capacitors are used both for equal division of total voltage among switching modules and for energy harvesting, in accordance with some embodiments.

FIG. 4B is a schematic diagram illustrating an example connection of a grading capacitor in an example HV switching device 420 wherein grading capacitors are used both for equal division of total voltage among switching modules and for energy harvesting. The example HV switching device 420 (e.g., HV circuit breaker or HV switch) includes a first switching module 422 connected in series with a second switching module 424. Each switching module 422, 424 includes a VI 426 having a first terminal 423 and a second terminal 425 and two grading capacitors 428 and 438 each with its terminals 427, 429 and 437, 439 respectively. For each module, the terminals 429 and 439 of both parallel grading capacitors 428, 438 are connected together to the node 435, and then through a low voltage switch 430 to the terminal 425 of the VI 426. The other terminals 427 and 437 of both capacitors 428, 438 are connected to the terminal 423 of the VI 426 for each module. The second terminal 425 of the example first switching module 422 is connected to the first terminal 423 of the example second switching module 424.

Each module in the example HV switch 420 also includes a full bridge rectifier 432 connected in parallel with the low voltage switch 430 between the node 435 and the terminal 425 of the VI 426. Each module in the example HV switch 420 further includes a storage capacitor 434 coupled to the full bridge rectifier 432 and configured to store rectified dc energy.

The grading capacitors 428, 438 in the HV switching device 420 can be used for energy harvesting in addition to voltage grading. The two grading capacitors 428 and 438 in parallel with a VI 426 represent two parallel HV capacitors (e.g., grading capacitors 110, grading capacitors 312, 314) created by the two sets of electrodes in parallel with the VI as described above. The terminals 429 and 439 corresponding to the moving VI side of both grading capacitors 428, 438 are not connected directly to the VI terminal 425, but through a low voltage switch 430. In an example physical arrangement, the inner electrode of one set and the outer electrode of the other set are connected together (at the node 435) and then, through the low voltage switch 430, to the VI terminal 425.

A full rectifier bridge 432 is connected in parallel with the low voltage switch 430. When the switch 430 is closed in each module 422, 424 and all VIs 426 are open, then each grading capacitor 428, 438 is in parallel with its corresponding vacuum interrupter 426 and the series string of the grading capacitors 428, 438 performs voltage division. When the semiconductor switch 430 is open in each module 422, 424 and all VIs 426 are open, then the same capacitive current (determined by equivalent series impedance of the string of grading capacitors 428, 438) is diverted into each of the rectifier bridges 432 and each of those bridges 432 charges its corresponding low voltage storage capacitor 434. When the voltage across capacitor 434 reaches a predetermined value for full charging, the low voltage switch 430 closes again and charging is stopped. This allows for energy to be harvested from a power line to which the switching device 420 is connected. In this example, the maximum harvested power can be estimated to be about 1.5 W per module (for 200 pF per capacitor). If higher harvested power per module is desired, then it is possible to increase grading capacitance per module by at least 5 times by pre-molding high dielectric constant dielectric between electrodes of grading capacitors as discussed above and shown in FIG. 2. This will increase harvested power per module by the factor by which dielectric constant is increased. The maximum voltage across the low voltage switches 430 can be designed to be within its datasheet specification (typically about 1 kV).

Low voltage switches 430 used in the example HV switching device 420 can be any switch that is able to conduct current in both directions, e.g., they can be mechanical switches, mechanical relays, semiconductor antiparallel switches or semiconductor relays.

The subject matter described herein provides an architecture wherein conductive electrodes are molded in a switch polymer housing to form pairs of relatively inexpensive HV grading capacitors of equal capacitance, each in parallel with its corresponding vacuum interrupter. The subject matter described herein provides an architecture wherein the HV grading capacitors may be used for energy harvesting across an open HV switching device. The harvested energy may be used for powering other functional components within the HV switching device.

For the sake of brevity, conventional techniques related to power distribution systems and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

The foregoing description may refer to elements or components or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements with direct electrical connections, additional intervening elements, devices, features, or components may be present in an embodiment of the depicted subject matter. In addition, certain terminology may also be used in the following description for the purpose of reference only, and thus are not intended to be limiting. For example, the terms "first," "second," and other such numerical terms referring to structures do not imply a sequence or order unless clearly indicated by the context.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment of the subject matter. It should be understood that various changes may be made in the function and arrangement of elements described in an exemplary embodiment without departing from the scope of the subject matter as set forth in the appended claims. Accordingly, details of the exemplary embodiments or other limitations described above should not be read into the claims absent a clear intention to the contrary.

What is claimed is:

1. A switching module for use in a high voltage switching device, the switching module comprising:

a vacuum interrupter (VI) having a fixed contact and a moving contact;

an insulating sleeve disposed around the VI;

an insulating housing of insulating material molded around the VI and the sleeve; and a pair of grading capacitors molded in the insulating housing and comprising a first grading capacitor and a second grading capacitor, each grading capacitor comprising an inner and an outer electrode that are concentric and an insulating member formed from the insulating material of the insulating housing disposed between the inner electrode and the outer electrode, wherein a capacitance of the first grading capacitor is substantially equal to a capacitance of the second grading capacitor.

2. The switching module of claim 1, wherein the inner electrode and outer electrode of both grading capacitors are molded out of conductive plastics.

3. The switching module of claim 2, wherein each of the inner electrode and the outer electrode of both grading capacitors extends in an arc around the VI in a plane normal to a VI axis extending longitudinally through a central region of the VI and the arc section extends in the VI axis direction for a specified length.

4. The switching module of claim 3, further comprising an arc angle of the arc for each of the inner electrodes and the outer electrodes that is less than 180° wherein a gap exists between arc ends of the inner and outer electrodes in each grading capacitor.

5. The switching module of claim 4, wherein the inner electrode and outer electrode of each grading capacitor share an axis with the VI but are offset axially.

6. The switching module of claim 5, wherein the inner electrode of both grading capacitors also includes a shield section attached to the arc section, wherein the shield section of the inner electrode extends 360° around the VI and provides shielding of an external triple point of the VI.

7. The switching module of claim 6, wherein the shield section of the inner electrode of the first grading capacitor is placed between the inner electrode of the second grading capacitor and the moving contact of the VI and wherein the shield section of the inner electrode of the second grading capacitor is placed between the inner electrode of the first grading capacitor and the fixed contact of the VI.

8. The switching module of claim 7, wherein the VI further comprises a fixed contact stem attached to the fixed contact, a moving contact stem attached to the moving contact, the inner electrode of the first capacitor and the outer electrode of the second capacitor are galvanically connected to the VI moving stem, while the inner electrode of the second capacitor and the outer electrode of the first capacitor are galvanically connected to the VI fixed stem, whereby the first and second grading capacitors are connected in parallel with the VI contacts.

9. The switching module of claim 8, wherein the arc angle of the arc section for each of the inner electrode and the outer electrode is approximately 150°.

10. The switching module of claim 9, wherein the inner electrode and outer electrode of both grading capacitors are offset axially by at least 1.5 inches.

11. The switching module of claim 7, wherein:

the VI further comprises a fixed contact stem attached to the fixed contact, and a moving contact stem attached to the moving contact;

the inner electrode of the first capacitor and the outer electrode of the second capacitor are galvanically connected to one terminal of a low voltage switch, while the other terminal of the low voltage switch is galvanically connected to the VI moving stem;

the inner electrode of the second capacitor and the outer electrode of the first capacitor are galvanically connected to the VI fixed stem; and the low voltage switch is either a mechanical or a semiconductor switch or relay and is configured to conduct current in both directions when closed;

whereby both the first and second grading capacitors are connected in parallel with the VI contacts, when the low voltage switch is closed.

12. The switching module of claim 11, wherein:

a full bridge rectifier is connected in parallel across the low voltage switch and a storage capacitor is coupled to the full bridge rectifier and configured to be charged by the full bridge rectifier; and when both the switch and VI in the switching module are open, the grading capacitors are configured to charge the storage capacitor whereby energy is harvested from a power line to which the HV switching device is connected.

13. A high voltage (HV) switching device, comprising:

two or more switching modules connected in series, each switching module comprising:

a vacuum interrupter (VI) having a fixed contact and a moving contact;

an insulating sleeve disposed around the VI;

an insulating housing of insulating material molded around the VI and the sleeve; and a pair of grading capacitors molded in the insulating housing and comprising a first grading capacitor and a second grading capacitor, each grading capacitor comprising an inner and an outer electrode that are concentric and an insulating member of insulating material disposed between the inner electrode and the outer electrode, wherein a capacitance of the first grading capacitor is substantially equal to a capacitance of the second grading capacitor, wherein the inner electrode and outer electrode of both grading capacitors are molded out of conductive plastics, wherein each of the inner electrode and the outer electrode of both grading capacitors extends in an arc around the VI in a plane normal to a VI axis extending longitudinally through a central region of the VI and the arc section extends in the VI axis direction for a specified length, wherein an arc angle of the arc for each of the inner electrodes and the outer electrodes is less than 180° wherein a gap exists between arc ends of the inner and outer electrodes in each grading capacitor, wherein the inner electrode and outer electrode of each grading capacitor share an axis with the VI but are offset axially, wherein the inner electrode of both grading capacitors also includes a shield section attached to the arc, wherein the shield section of the inner electrode extends 360° around the VI and provides shielding of an external triple point of the VI, wherein the shield section of the inner electrode of the first grading capacitor is placed between the inner electrode of the second grading capacitor and the moving contact of the VI and wherein the shield section of the inner electrode of the second grading capacitor is placed between the inner electrode of the first grading capacitor and the fixed contact of the VI, and wherein the VI further comprises a fixed contact stem attached to the fixed contact, a moving contact stem attached to the moving contact, the inner electrode of the first capacitor and the outer electrode of the second capacitor are galvanically connected to the VI moving stem, while the inner electrode of the second capacitor and the outer electrode of the first capacitor are galvanically connected to the VI fixed stem, whereby the first and second grading capacitors are connected in parallel with the VI contacts;

wherein each switching module has a first and a second terminal and wherein each pair of adjacent switching modules are connected in series with the second terminal of one of the pair of switching modules connected to the first terminal of an other of the pair of switching modules, each switching module has a same total capacitance of the pair of grading capacitors across an associated VI and, when the HV switching device is in an open position and high voltage is applied across the HV switching device, substantially an equal portion of an applied high voltage exists across each of the switching modules of the HV switching device.

14. The HV switching device of claim 13, wherein the arc angle of the arc section for each of the inner electrode and the outer electrode is approximately 150° and wherein the inner electrode and outer electrode of both grading capacitors are offset axially by at least 1.5 inches.

15. The HV switching device of claim 14, wherein:

when, in each switching module, both the VI and a low voltage switch coupled between the grading capacitors and the VI are open, capacitive current from the grading capacitors is diverted into a rectifier bridge in each switching module which charges a storage capacitor, whereby energy is harvested from a power line to which the HV switching device is connected.

16. The HV switching device of claim 14, wherein:

when, in each switching module, both the VI and a low voltage switch coupled between the grading capacitors and the VI are open, capacitive current from the grading capacitors is diverted into a rectifier bridge in each switching module which charges a storage capacitor, whereby energy is harvested from a power line to which the HV switching device is connected.

17. A high voltage (HV) switching device, comprising:

two or more switching modules connected in series, each switching module comprising:

a vacuum interrupter (VI) having a fixed contact and a moving contact;

an insulating sleeve disposed around the VI;

an insulating housing of insulating material molded around the VI and the sleeve; and a pair of grading capacitors molded in the insulating housing and comprising a first grading capacitor and a second grading capacitor, each grading capacitor comprising an inner and an outer electrode that are concentric and an insulating member formed of the insulating material disposed between the inner electrode and the outer electrode, wherein a capacitance of the first grading capacitor is substantially equal to a capacitance of the second grading capacitor, wherein each switching module has a first and a second terminal and wherein each pair of adjacent switching modules are connected in series with the second terminal of one of the pair of switching modules connected to the first terminal of the other of the pair of switching modules, all the switching modules have a same total capacitance of the pair of grading capacitors across an associated VI and, when the HV switching device is in an open position and high voltage is applied across the HV switching device, substantially an equal portion of an applied high voltage exists across each of the switching modules of the HV switching device.

18. The HV switching device of claim 17, wherein:

when, in each switching module, the VI is open and a low voltage switch coupled between the grading capacitors and the VI is closed, and high voltage is applied across the HV switching device, substantially an equal portion of the applied high voltage exists across each of the switching modules of the HV switching device.

19. The HV switching device of claim 17, wherein:

when, in each switching module, both the VI and a low voltage switch coupled between the grading capacitors and the VI are open, capacitive current from the grading capacitors is diverted into a rectifier bridge in each switching module which charges a storage capacitor, whereby energy is harvested from a power line to which the HV switching device is connected.

20. The HV switching device of claim 17, wherein:

each of the inner electrode and the outer electrode of both grading capacitors extends in an arc around the VI in a plane normal to a VI axis extending longitudinally through a central region of the VI and the arc section extends in the VI axis direction for a specified length; and an arc angle of the arc for each of the inner electrodes and the outer electrodes is approximately 150° wherein a gap exists between arc ends of the inner and outer electrodes in each grading capacitor.

* * * * *